US008528336B2

(12) United States Patent
Cihlar et al.

(10) Patent No.: US 8,528,336 B2
(45) Date of Patent: Sep. 10, 2013

(54) FUEL NOZZLE SPRING SUPPORT FOR SHIFTING A NATURAL FREQUENCY

(75) Inventors: David Cihlar, Greenville, SC (US); Christopher Paul Keener, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 1415 days.

(21) Appl. No.: 12/413,639

(22) Filed: Mar. 30, 2009

(65) Prior Publication Data

US 2010/0242493 A1 Sep. 30, 2010

(51) Int. Cl.
*F02C 1/00* (2006.01)

(52) U.S. Cl.
USPC ..... 60/740; 60/756

(58) Field of Classification Search
USPC ..... 60/737, 740, 756, 752
See application file for complete search history.

(56) References Cited

U.S. PATENT DOCUMENTS

| | | | | |
|---|---|---|---|---|
| 4,285,633 | A * | 8/1981 | Jones | 415/191 |
| 5,274,991 | A * | 1/1994 | Fitts | 60/800 |
| 5,357,745 | A * | 10/1994 | Probert | 60/39.37 |
| 6,334,310 | B1 | 1/2002 | Sutcu et al. | |
| 6,547,256 | B2 * | 4/2003 | Aksit et al. | 277/628 |
| 7,082,766 | B1 | 8/2006 | Widener et al. | |
| 2003/0000216 | A1 * | 1/2003 | Akagi et al. | 60/746 |
| 2006/0042269 | A1 * | 3/2006 | Markarian et al. | 60/796 |
| 2009/0188255 | A1 * | 7/2009 | Green et al. | 60/737 |
| 2010/0018210 | A1 * | 1/2010 | Fox et al. | 60/746 |
| 2010/0300116 | A1 * | 12/2010 | Kaleeswaran et al. | 60/800 |

* cited by examiner

*Primary Examiner* — Gerald Sung
(74) *Attorney, Agent, or Firm* — Sutherland Asbill & Brennan LLP

(57) ABSTRACT

The present application provides a fuel nozzle spring support system. The fuel nozzle spring support system may include a fuel nozzle, a cap assembly, and a spring support positioned between the fuel nozzle and the cap assembly.

20 Claims, 4 Drawing Sheets

FUEL NOZZLE SPRING SUPPORT FOR SHIFTING A NATURAL FREQUENCY

TECHNICAL FIELD

The present application relates generally to gas turbine engines and more particularly relates to a spring support used to position a fuel nozzle within a cap assembly of a turbine combustor.

BACKGROUND OF THE INVENTION

Gas turbine engines generally include a combustor with a number of fuel nozzles positioned therein in various configurations. For example, a DLN2.6+ ("Dry Low NOx") combustion system offered by General Electric Corporation of Schenectady, N.Y. provides a six fuel nozzle configuration with a center fuel nozzle surrounded by five outer fuel nozzles. Such a combustion system mixes one or more fuel streams and air streams before entry into a reaction or a combustion zone. Such premixing tends to reduce overall combustion temperatures as well as undesirable emissions such as nitrogen oxides (NOx).

As is known, the fuel nozzles generally include a number of fuel and air tubes mounted onto a flange. In the DLN2.6+ combustion system, the fuel nozzles may be positioned within a cap assembly in a somewhat cantilevered fashion. The combination of the cantilevered structure and the natural frequency of the center fuel nozzles, however, have caused somewhat high amplitude resonance that has resulted in issues with respect to a braised joint between the flange and one of the outer premixed tubes.

Although the design of the fuel nozzle and the cap assembly may be revised to eliminate the issue with the joint, there is a considerable amount of equipment currently operating in the field. There is a desire therefore for systems and methods to dampen or at least to shift the natural frequency of the center fuel tube so as to avoid any issues that may arise with high amplitude resonance. The systems and methods preferably can dampen or shift the natural frequency of the fuel nozzle without extensive equipment replacement or modification costs.

SUMMARY OF THE INVENTION

The present application thus provides a fuel nozzle spring support system. The fuel nozzle spring support system may include a fuel nozzle, a cap assembly, and a spring support positioned between the fuel nozzle and the cap assembly.

The present application further provides a method of operating a combustor having a fuel nozzle and a cap assembly. The method may include the steps of sizing a spring support to alter the natural frequency of the fuel nozzle, positioning the spring support between the fuel nozzle and the cap assembly, and operating the fuel nozzle at the altered natural frequency.

The present application further provides a fuel nozzle spring support system. The fuel nozzle spring support system may include a fuel nozzle, a cap assembly, and a spring support positioned between the fuel nozzle and the cap assembly. The spring support may include a hula seal and a collar.

These and other features of the present application will become apparent to one of ordinary skill in the art upon review of the following detailed description when taken in conjunction with the several drawings and the appended claims.

DETAILED DESCRIPTION

Figure 1:
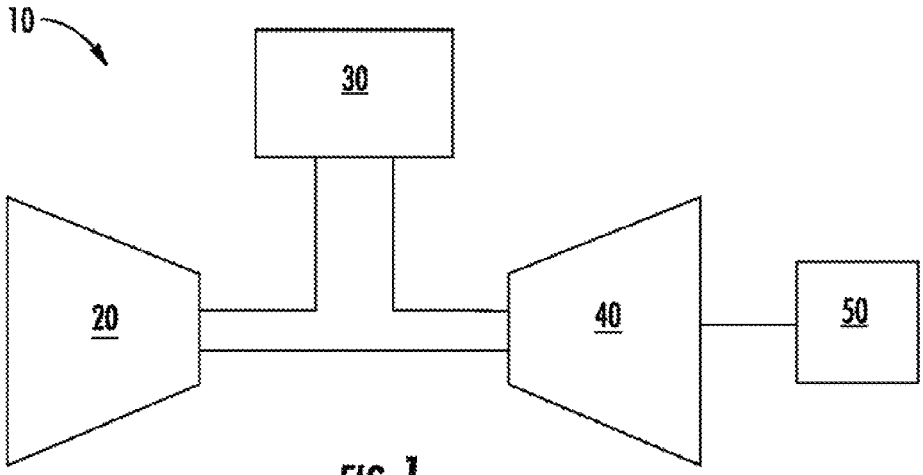
FIG. 1 (Prior Art)
FIG. 1 is a schematic view of a gas turbine engine.

Referring now to the drawings, in which like numbers refer to like elements throughout the several views, FIG. 1 shows a schematic view of a gas turbine engine 10. As is known, the gas turbine engine 10 may include a compressor 20 to compress an incoming flow of air. The compressor 20 delivers the compressed flow of air to a combustor 30. The combustor 30 mixes the compressed flow of air with a compressed flow of fuel and ignites the mixture. (Although a single combustor 30 is shown, the gas turbine engine 10 may include any number of combustors 30.) The hot combustion gases are in turn delivered to a turbine 40. The hot combustion gases drive the turbine 40 so as to produce mechanical work. Mechanical work produced by the turbine 40 drives the compressor 20 and an external load 50 such as an electrical generator and the like. The gas turbine engine 10 may use natural gas, various types of syngas, and other types of fuels. The gas turbine engine 10 may have other configurations and may use other types of components herein.

Figure 2:
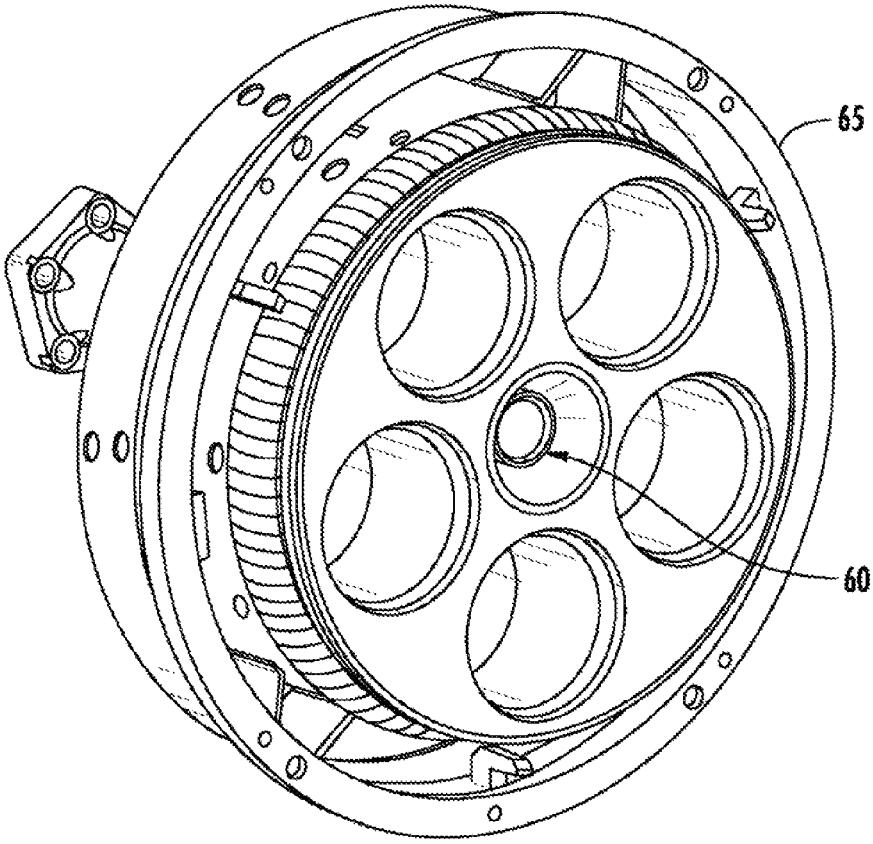
FIG. 2 (Prior Art)
FIG. 2 is a perspective view of a known fuel nozzle and cap assembly.
Figure 3:
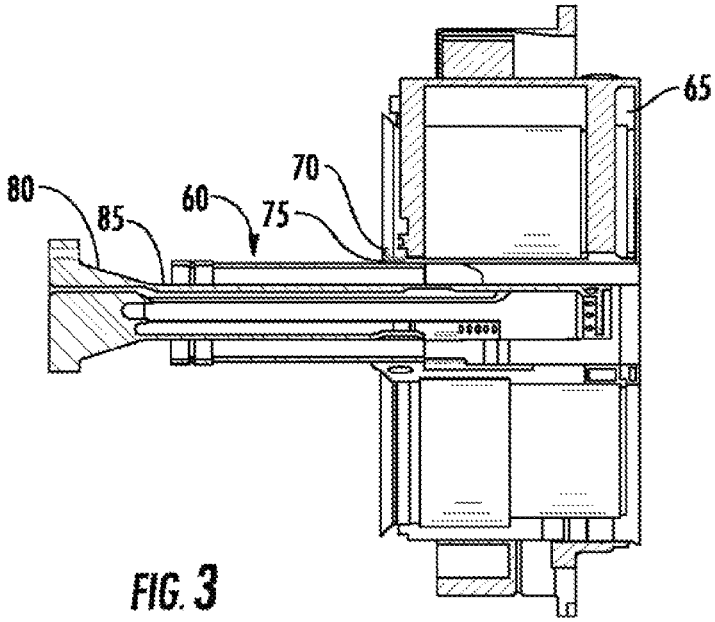
FIG. 3 (Prior Art)
FIG. 3 is a side cross-sectional view of the fuel nozzle and cap assembly of FIG. 2.
Figure 4:
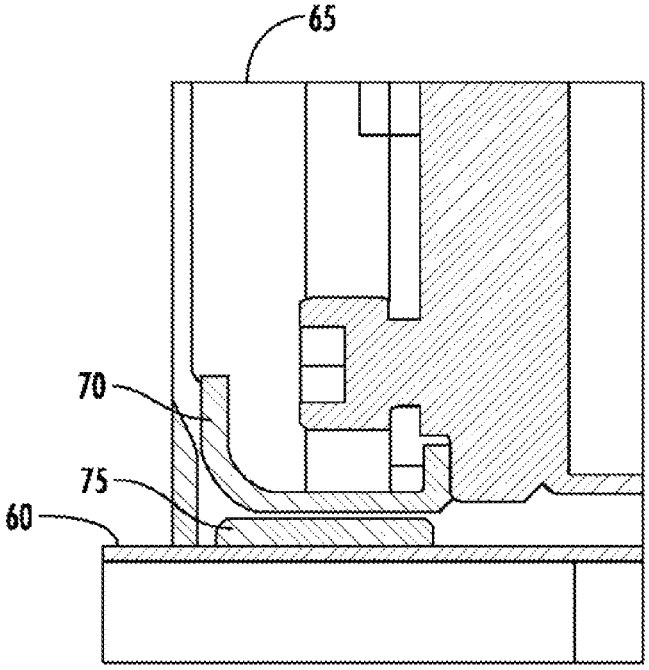
FIG. 4 (Prior Art)
FIG. 4 is a side cross-sectional view of a machined ring of the fuel nozzle and a floating collar of the cap assembly of the FIG. 2.

FIGS. 2 through 4 show an existing fuel nozzle 60. Specifically, a 9FBA center fuel nozzle 60 is shown. The fuel nozzle 60 is positioned within a cap assembly 65. The cap assembly 65 may be part of the DLN2.6+ combustion system. As is shown, the DLN2.6+ combustion system uses a five around one nozzle configuration. Specifically, the nozzle 60 is held within the cap assembly 65 via a floating collar 70 riding along a machined ring 75 on the fuel nozzle 60. The 9FBA center fuel nozzle 60 operates at about zero margin to 3/rev rotor speed. As described above, high amplitude resonance has resulted in issues between a flange 80 and an outer premixer tube 85 of the fuel nozzle 60.

Figure 5:
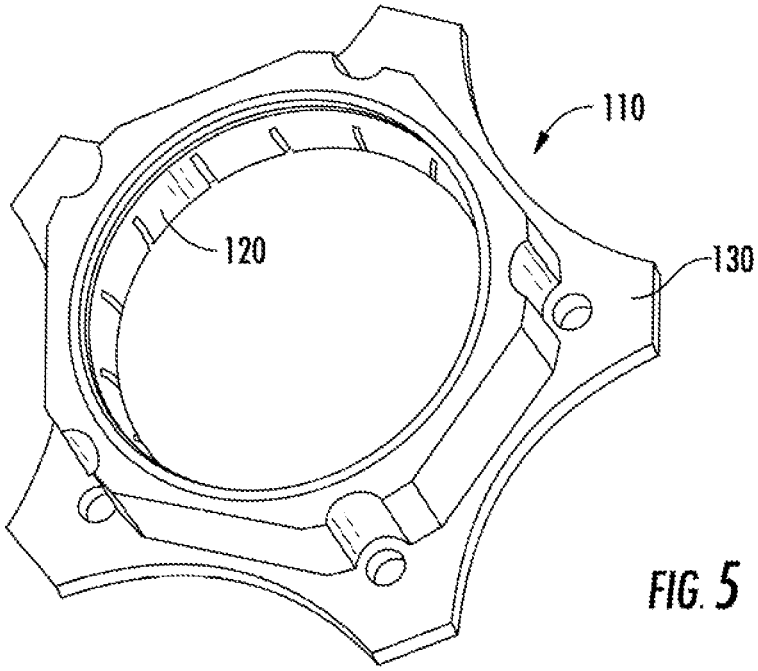
FIG. 5 is a perspective view of a fuel nozzle spring support as is described herein.
Figure 6:
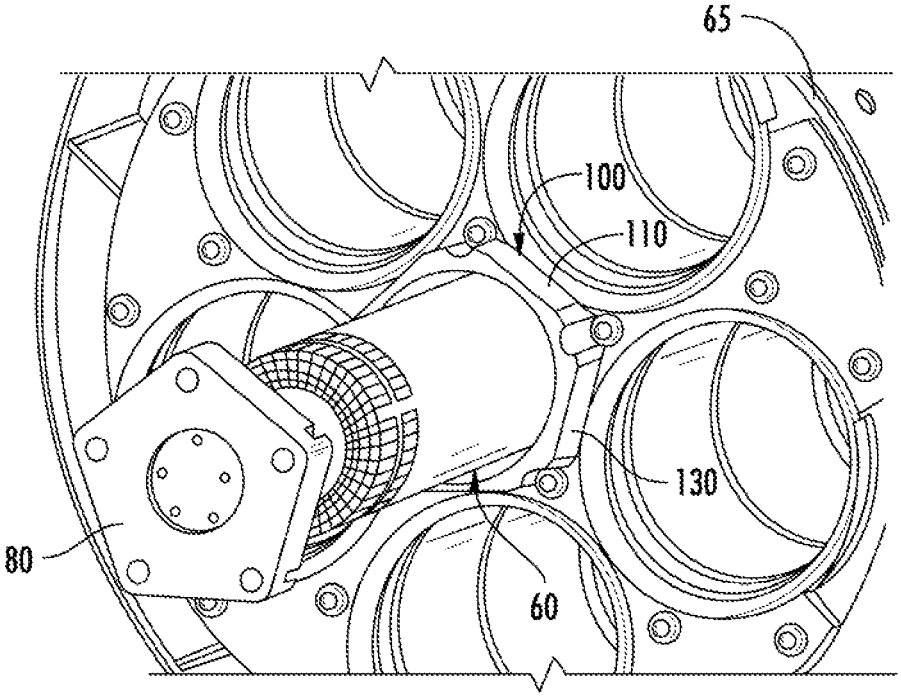
FIG. 6 is a perspective view of a fuel nozzle spring support system as is described herein with a fuel nozzle and a cap assembly.
Figure 7:
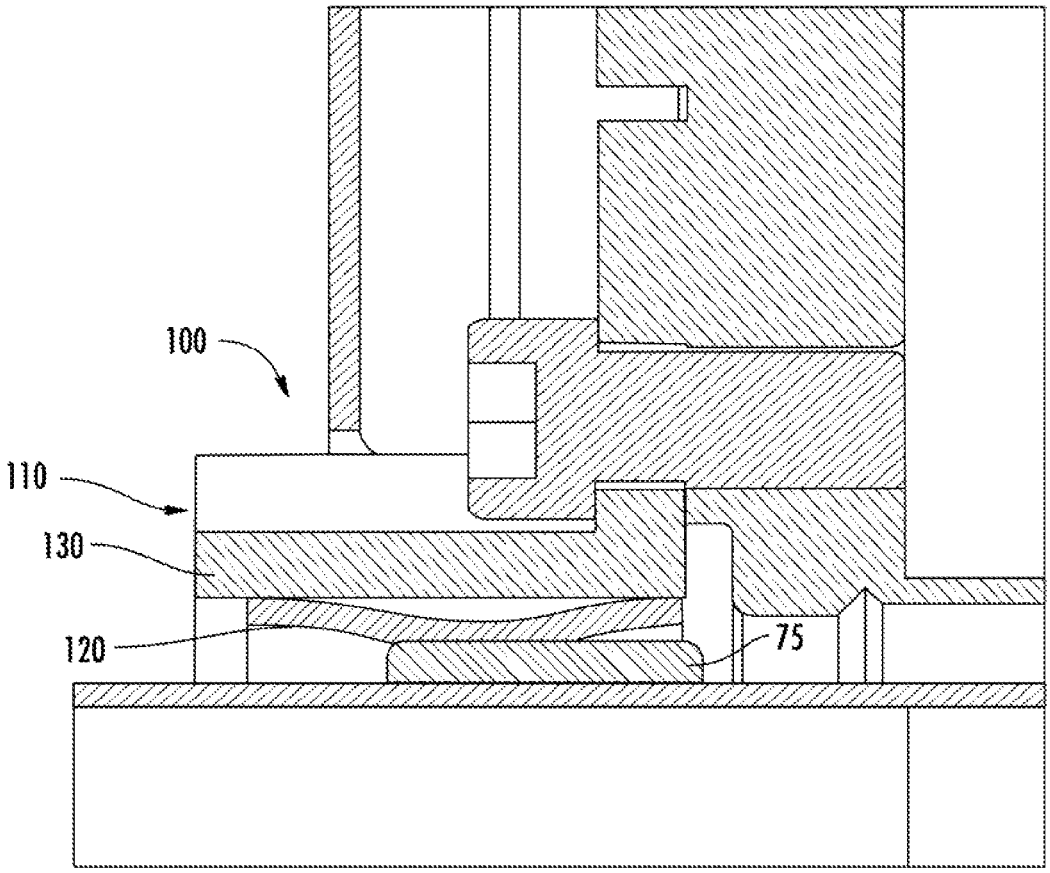
FIG. 7 is a side cross-sectional view of a machined ring of the fuel nozzle, the spring support, and the cap assembly of the FIG. 6.

FIGS. 5 through 7 show a fuel nozzle spring system 100 as is described herein. The fuel nozzle spring support system 100 includes a spring support 110 positioned between the fuel nozzle 60 and the cap assembly 65. As is shown in FIG. 5, the spring support 110 includes a hula seal 120 positioned within an outer collar 130. As described in, for example, commonly owned U.S. Pat. No. 6,334,310, the hula seal 120 is defined as a system of leaf springs formed into a round loop. The hula seal 120 generally is used to seal a sliding interface joint or annular cap between two concentric ducts.

The hula seal 120 provides spring stiffness and dampening to the fuel nozzle spring system 100. As is shown in FIGS. 6 and 7, the hula seal 120 may be positioned against the machined ring 70 of the fuel nozzle 60 instead of the use of the floating collar 70. The hula seal 120 supports the fuel nozzle 60 at a full 360 degrees around. The spring support 110 may use a number of hula seals 120 therein. In addition to providing stiffness, frictional losses in the hula seal 120 may provide mechanical damping to reduce vibration amplitudes.

The use of the hula seal 120 at the mid-span of the fuel nozzle 60 thus may increase the natural frequency of the nozzle 60. Specifically, the hula seal 120 may raise the first natural frequency of the nozzle 60 from about 150 Hz to above about 230 Hz. Based upon the available space, the hula seal 120 may increase the natural frequency by about four times or more. The hula seal 120 and the stiffness of the seal may be sized to move the natural frequency of the fuel nozzle to a desired range. The hula seal 120 preferably has a stiffness of about 70 klb/in and may range from about 30 klb/in to over about 150 klb/in. The hula seal 120 may be made out of Inconel X750 (a Nickel-Chromium alloy made precipitation hardenable by additions of Aluminum and Titanium, having creep-rupture strength at high temperatures to about 700° C. (1290° F.)) or similar types of materials.

The use of the spring support 110 thus avoids costly retrofitting of the center fuel nozzle 60 and the cap assembly 65. Moreover, the use of the spring support 110 may be retrofitted on site. The spring support 110 likewise may increase the useful lifetime of the fuel nozzle 60.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A fuel nozzle spring support system comprising a fuel nozzle; a cap assembly, wherein the fuel nozzle is received within an opening defined in an upstream end face of the cap assembly, and wherein the upstream end face is substantially perpendicular to an axis of the fuel nozzle; and a spring support attached to the upstream end face of the cap assembly at the opening, wherein the spring support comprises a hula seal, wherein the spring support surrounds and contacts a portion of the fuel nozzle adjacent the opening, and wherein the spring support is configured to shift a natural frequency of the fuel nozzle to reduce resonance.

2. The fuel nozzle spring support system of claim 1, wherein the hula seal comprises a plurality of leaf springs formed in a loop, and wherein the hula seal surrounds and contacts the portion of the fuel nozzle adjacent the opening.

3. The fuel nozzle spring support system of claim 2, wherein the spring support further comprises a collar surrounding the hula seal, and wherein the collar is attached to the upstream end face of the cap assembly.

4. The fuel nozzle spring support system of claim 2, wherein the hula seal surrounds and contacts the portion of the fuel nozzle adjacent the opening at the mid-span of the fuel nozzle.

5. The fuel nozzle spring support system of claim 2, wherein the hula seal has a stiffness of 30 to 150 klb/in.

6. The fuel nozzle spring support system of claim 2, wherein the hula seal comprises a Nickel-Chromium alloy.

7. The fuel nozzle spring support system of claim 1, wherein the spring support comprises a plurality of hula seals each comprising a plurality of leaf springs formed in a loop, and wherein each of the hula seals surrounds and contacts the portion of the fuel nozzle adjacent the opening.

8. The fuel nozzle spring support system of claim 1, wherein the fuel nozzle comprises a ring forming an outer circumference of the fuel nozzle, and wherein the spring support surrounds and contacts the ring.

9. The fuel nozzle spring support system of claim 1, wherein the spring support is configured to shift the natural frequency of the fuel nozzle to be greater than 230 Hz.

10. The fuel nozzle spring support system of claim 1, wherein the fuel nozzle comprises a center fuel nozzle, and wherein the opening is positioned at a center of the upstream end face of the cap assembly.

11. The fuel nozzle spring support system of claim 3, wherein the collar comprises a flange, and wherein the flange is attached to the upstream end face of the cap assembly adjacent the opening.

12. A fuel nozzle spring support system, comprising: a fuel nozzle; a cap assembly, wherein the fuel nozzle is received within an opening defined in an upstream end face of the cap assembly, and wherein the upstream end face is substantially perpendicular to an axis of the fuel nozzle; and a spring support attached to the upstream end face of the cap assembly at the opening; wherein the spring support comprises a hula seal and a collar surrounding the hula seal, wherein the hula seal comprises a plurality of leaf springs formed in a loop, wherein the hula seal surrounds and contacts a portion of the fuel nozzle adjacent the opening, and wherein the hula seal is configured to shift a natural frequency of the fuel nozzle to reduce resonance.

13. The fuel nozzle spring support system of claim 12, wherein the hula seal surrounds and contacts the portion of the fuel nozzle adjacent the opening at the mid-span of the fuel nozzle.

14. The fuel nozzle spring support system of claim 12, wherein the hula seal has a stiffness of 30 to 150 klb/in.

15. The fuel nozzle spring support system of claim 12, wherein the hula seal comprises a Nickel-Chromium alloy.

16. The fuel nozzle spring support system of claim 12, wherein the spring support comprises a plurality of hula seals each comprising a plurality of leaf springs formed in a loop, and wherein each of the hula seals surrounds and contacts the portion of the fuel nozzle adjacent the opening.

17. The fuel nozzle spring support system of claim 12, wherein the fuel nozzle comprises a ring forming an outer circumference of the fuel nozzle, and wherein the hula seal surrounds and contacts the ring.

18. The fuel nozzle spring support system of claim 12, wherein the spring support is configured to shift the natural frequency of the fuel nozzle to be greater than 230 Hz.

19. The fuel nozzle spring support system of claim 12, wherein the fuel nozzle comprises a center fuel nozzle, and wherein the opening is positioned at a center of the upstream end face of the cap assembly.

20. The fuel nozzle spring support system of claim 12, wherein the collar comprises a flange, and wherein the flange is attached to the upstream end face of the cap assembly adjacent the opening.

* * * * *